US006070769A

United States Patent [19]

Hornsby

[11] Patent Number: 6,070,769

[45] Date of Patent: Jun. 6, 2000

[54] FILLER ASSEMBLY FOR PORTABLE FUEL JUG

[76] Inventor: Gary Eugene Hornsby, 21054 N. 34th Ave., Phoenix, Ariz. 85027-3076

[21] Appl. No.: 09/165,929

[22] Filed: Oct. 2, 1998

[51] Int. Cl.[7] ..... B65D 25/00

[52] U.S. Cl. ..... 222/529; 222/527; 222/531; 138/109; 138/133

[58] Field of Search ..... 222/527–531; 138/89.3, 109, 133

[56] References Cited

U.S. PATENT DOCUMENTS

| | | | |
|---|---|---|---|
| 2,561,578 | 7/1951 | Koester | 222/527 |
| 3,918,749 | 11/1975 | Taylor | 285/256 |
| 4,426,027 | 1/1984 | Maynard, Jr. | 222/529 |
| 4,548,344 | 10/1985 | Hesthave et al. | 222/527 |
| 4,675,780 | 6/1987 | Barnes et al. | 138/109 |
| 5,381,834 | 1/1995 | King | 138/125 |

*Primary Examiner*—J. Casimer Jacyna
*Attorney, Agent, or Firm*—Parsons & Goltry; Robert A. Parsons; Michael W. Goltry

[57] ABSTRACT

A filler assembly includes a flexible hose having a predetermined length and a helical wire reinforcement within the hose to prevent collapse. A first coupling at one end of the hose attaches the filler assembly to a portable fuel jug. The coupling includes a threaded end and a cup-shaped end for receiving a barb attached to the flexible hose. A second coupling at the other end of the tubing adapts the filler assembly to the fuel tank of a vehicle. The second coupling includes a cup-shaped portion for receiving a second barb that fits within the hose. The second coupling also includes threaded, cylindrical portion that is sealed by a threaded cap. The cylindrical portion of the second coupling can be long or short, bent or straight, threaded or unthreaded.

12 Claims, 3 Drawing Sheets

FILLER ASSEMBLY FOR PORTABLE FUEL JUG

BACKGROUND OF THE INVENTION

This invention relates to filler assemblies for portable fuel tanks or "jugs" primarily for recreational vehicles and, in particular, to a safer filler assembly for such fuel jugs.

Recreational vehicles, such as all-terrain vehicles (ATVs) and all-terrain cycles (ATCs), snowmobiles, jet skis, go-karts, sand rails, motorcycles, off-road competition automobiles, or ultra-light aircraft, are characterized by a relatively small gasoline engine and a correspondingly small fuel tank in order to conserve weight. During a typical outing, a vehicle will be refueled several times. Commercially available filler assemblies for coupling a portable fuel jug to the fuel tank in the vehicle typically include a short vinyl tube with a plastic coupling inserted at one end for attachment to the portable fuel jug and a plastic plug in the other end. During refueling, the plastic plug is removed and the open end of the filler assembly is inserted into the fuel tank of the vehicle.

Filler assemblies of the prior art deteriorate quickly, particularly in warm weather, usually by bending, kinking, and eventually cracking. A vinyl tube cannot withstand kinking more than once or twice before cracks develop. Cracks may also develop from chemical deterioration of the tube and flexing during refueling. If the assembly is plugged to prevent fumes from escaping, the plug often pops from the assembly as air in the portable fuel jug expands with temperature. Whether from cracking or losing a plug, there is usually at least one portable fuel jug venting explosive fumes at a gathering of contestants or revelers.

The plug on the end of the hose can be a source of dirt and grit, particularly for jugs containing fuel for two cycle engines. Such fuel is particularly oily and a wetted plug can collect a considerable amount of dirt if allowed to roll around on the ground. Because a plug will typically pop at one time or another, the accumulated dirt is transferred to the fuel in a jug.

A wide variety of filler assemblies are known in the art for transferring liquids. The problem is providing a rugged yet economical assembly suitable for recreational vehicles. Fuel assemblies such as found on the pumps at a service station are far too complex and expensive. It is known in the art to use barbed couplings fitting within a assembly. U.S. Pat. No. 3,918,749 (Taylor) discloses a assembly for transporting cement in which a coupling having a barbed shank fits within the assembly and is clamped by a ferrule. The assembly includes a wire reinforcement within the assembly. U.S. Pat. No. 5,381,834 (King) discloses a assembly for transporting liquids under high pressure. The assembly includes a coupling having a barbed shank within the assembly. A collar fastens the assembly to the shank. British Specification 376,004 (White) discloses end caps for protecting the threaded ends of metal tubes.

In view of the foregoing, it is therefore an object of the invention to provide an improved filler assembly for portable fuel jugs.

Another object of the invention is to provide a filler assembly that resists collapse of the hose wall while bending or flexing during refueling.

A further object of the invention is to provide a filler assembly that can withstand chemical deterioration.

Another object of the invention is to provide a filler assembly that can withstand pressures due to thermal expansion or contraction of air within a portable fuel jug to which the assembly is connected.

A further object of the invention is to provide an improved mechanism for capping a filler assembly for a portable fuel jug.

Another object of the invention is to provide a tethered end cap.

SUMMARY OF THE INVENTION

The foregoing objects are achieved by this invention in which the filler assembly includes a flexible hose having a predetermined length and a helical wire reinforcement within the hose to prevent the walls from collapsing. A first coupling at one end of the hose attaches the filler assembly to a portable fuel jug. The coupling includes a threaded end and a cup-shaped end for receiving a barb attached to the flexible hose. A second coupling at the other end of the tubing adapts the filler assembly to the fuel tank of a vehicle. The second coupling includes a cup-shaped portion for receiving a second barb that fits within the hose. The second coupling also includes threaded, cylindrical portion that is sealed by a threaded cap. The cylindrical portion of the second coupling can be short, elongated, bent or curved.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
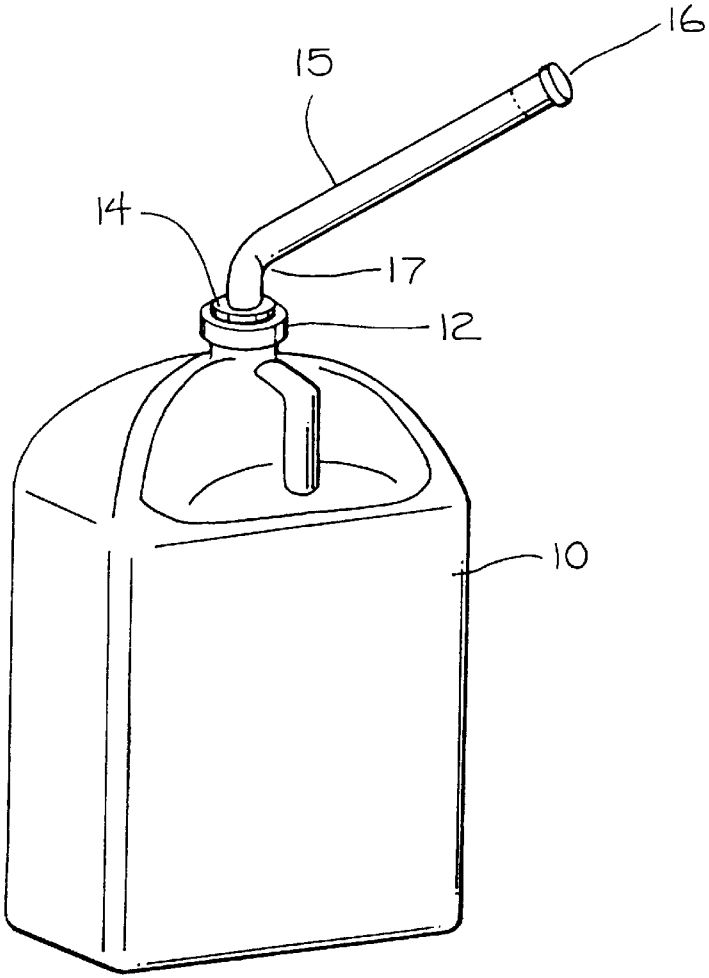
FIG. 1 illustrates a portable fuel jug of the prior art wherein the hose is collapsing under its own weight.

In FIG. 1, portable fuel jug 10 includes cap 12 for receiving fitting 14 at a first end of filler assembly 15. The other end of filler assembly 15 is sealed by plug 16. Filler assemblies for recreational vehicles come in different sizes but are typically twelve to twenty-four inches long and have an inside diameter of three-quarters of an inch. New assemblies use hoses that stand relatively upright, making them awkward to bend while filling a vehicle. Despite any initial stiffness, the hose eventually bends under its own weight, collapsing the wall of the hose and causing kink 17, usually near fitting 14. At the site of the kink, a crack will form in the wall of the hose, allowing fumes or fuel to leak from the filler assembly.

Figure 2:
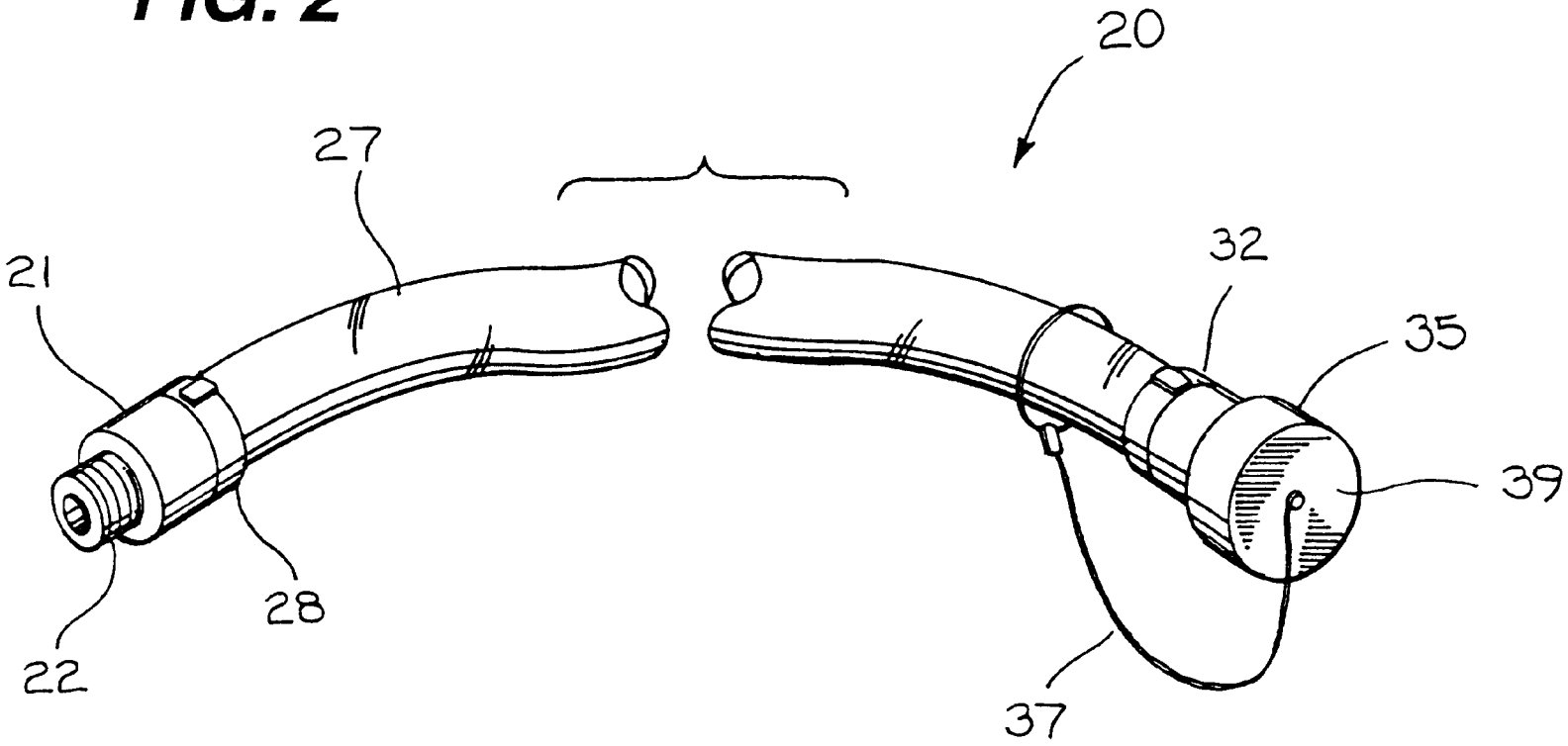
FIG. 2 is a perspective view of a filler assembly constructed in accordance with the invention.
Figure 3:
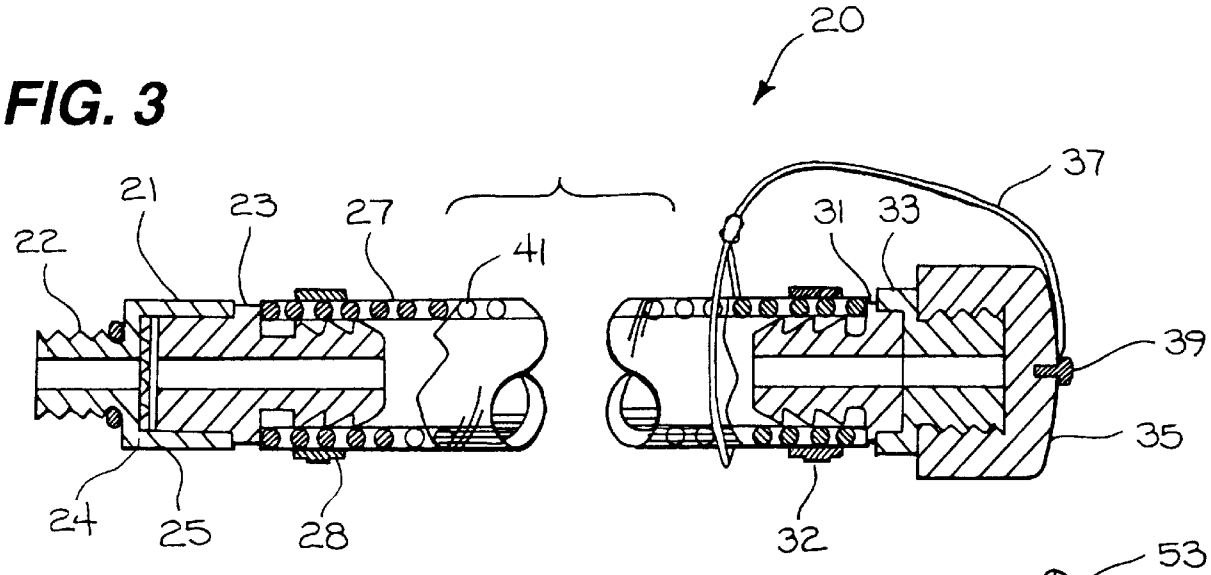
FIG. 3 is a longitudinal cross-section of the filler assembly illustrated in FIG. 1.

Referring to FIGS. 2 and 3, filler assembly 20 is constructed in accordance with the invention and includes coupling 21 at one end for attaching the filler assembly to the cap of a portable fuel jug (not shown). Coupling 21 is threaded on one end, e.g. with a male pipe thread 22, and has a hollow cylindrical section for receiving barb 23 (FIG. 3). Barb 23 is cemented within coupling 21, trapping filter 24 and O-ring 25. Hose 27 is secured to barb 23 by clamp 28. At the second end of hose 27, barb 31 is secured to the hose by clamp 32 and is cemented within the cylindrical end of coupling 33. The threaded end of coupling 33 receives cap 35. Cap 35 is internally threaded and screws on to coupling 33 to seal filler assembly 20. The threads can be straight or a pipe thread. Cap 35 is tethered to hose 27 by a closed loop of wire 37 encircling the assembly and attached to the cap by screw 39.

Hose 27 includes an embedded coil of helical wire 41 that provides resistance to collapsing yet does not make the assembly too rigid to bend as needed. Wire 41 is contained within the cylindrical wall defined by the inner and outer surfaces of hose 27, completely covered by the hose, thereby protecting the wire from fuel or other chemicals and protecting the fuel from flushing rust or other contaminants from the wire. A preferred hose is commercially available from Kuryama as "polywire" reinforced tubing. Other tubing could be used instead. The couplings are preferably made from schedule 80 polyethylene plastic and fastened to the barbs by solvent glue.

Filler assembly 20 is used in just the same manner as filler assemblies of the prior art. The only maintenance that may be necessary is to clean filter 24, which is preferably made from 40-mesh screening. Filter 24 is cleaned by reverse flow through the assembly with fuel, a liquid flushing agent, or compressed air.

Figure 4:
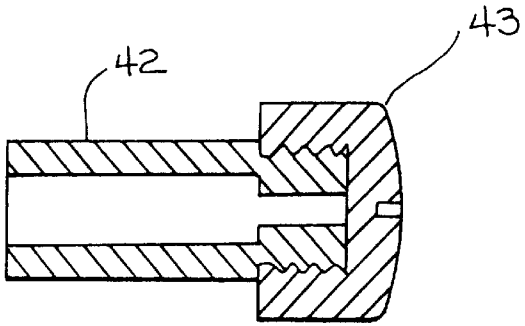
FIG. 4 is a cross-section of a coupling constructed in accordance with another aspect of the invention.

FIG. 4 illustrates a sealable coupling constructed in accordance with an alternative embodiment of the invention. Coupling 42 is elongated to provide a rigid section that is narrower than the flexible hose portion of the filler assembly. The embodiment of FIG. 4 is particularly suited to filling cars or some jet skis, where the gas tank or filler opening is on the side of the vehicle. Cap 43 screws on to the threaded end of coupling 42 to seal the free end of the filler assembly.

Figure 5:
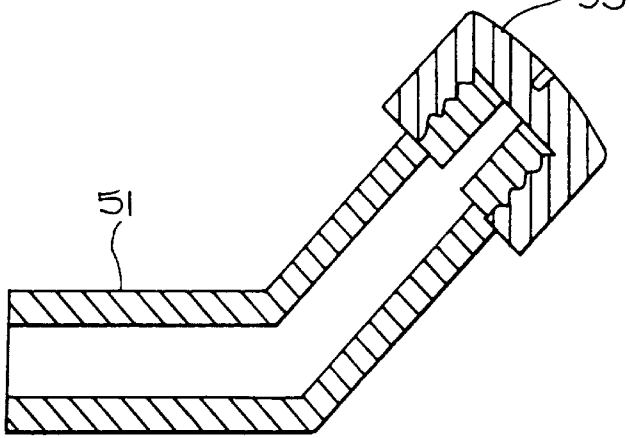
FIG. 5 illustrates an alternative embodiment of the coupling illustrated in FIG. 4.

FIG. 5 illustrates a sealable coupling constructed in accordance with an alternative embodiment of the invention. Coupling 51 is elongated and angled to facilitate filling tanks of vehicles where the opening for the gas tank is on the upper surface of the vehicle, such as an ultra-light aircraft. For motorcycles there is an additional advantage because the narrow neck enables one to see the fuel rising in the gas tank on the motorcycle, thereby avoiding overfilling. An angle of approximately 45° is preferred, although any angle from less than 30° to more than 60° can be used. Cap 53 screws on to the threaded end of coupling 51 to seal the free end of the filler assembly.

The invention thus provides an improved filler assembly for portable fuel jugs that resists kinking, bends easily, and can withstand chemical deterioration. The filler assembly can be closed or sealed and the seal can withstand pressures due to thermal expansion or contraction of air within a portable fuel jug to which the assembly is connected. Although well made, rugged, and durable, the filler assembly is economical when compared to the purchase of several filler assemblies of the prior art, which the filler assembly of the invention can outlast.

Having thus described the invention., it will be apparent to those of skill in the art that various modifications can be made within the scope of the invention. For example, the couplings could fit within the barbs instead of the barbs fitting within the couplings. The barbs and couplings can be made from a single piece of plastic. The tether can be attached by a rivet or means other than a screw.

What is claimed as the invention is:

1. A filler assembly for coupling a portable fuel jug to the fuel tank of a vehicle, said filler assembly comprising:

a flexible hose having an inner surface and an outer surface defining a cylindrical wall between the surfaces, said hose having a predetermined length between a first end and a second end;

a wire reinforcement within said hose to prevent collapse;

a first coupling at said first end for attaching said filler assembly to said portable fuel jug;

a first barb fitting within said hose and attached to said first coupling;

a second coupling at said second end for inserting into the fuel tank of said vehicle;

a second barb fitting within said hose and attached to said second coupling; and a filter captured between the first coupling and the first barb fitting.

2. The filler assembly as set forth in claim 1 and further including:

a first clamp encircling said first end for securing said hose to said first barb; and a second clamp encircling said second end for securing said hose to said second barb.

3. The filler assembly as set forth in claim 1 and further including:

an end cap attached to said second coupling for sealing the second end of said filler assembly.

4. The filler assembly as set forth in claim 3 wherein second coupling is threaded and said end cap is threaded onto said second coupling.

5. The filler assembly as set forth in claim 1 wherein said wire reinforcement is a helical wire.

6. The filler assembly as set forth in claim 5 wherein said helical wire is contained within said wall.

7. The filler assembly as set forth in claim 6 wherein said first barb is glued to said first coupling and said second barb is glued to said second coupling.

8. A filler assembly for coupling a portable fuel jug to the fuel tank of a vehicle, said filler assembly comprising:

a flexible hose having an inner surface and an outer surface defining a cylindrical wall between the surfaces, said hose having a predetermined length between a first end and a second end;

a helical wire reinforcement contained within the cylindrical wall of said hose to prevent collapse;

a first coupling at said first end for attaching said filler assembly to said portable fuel jug;

a first barb fitting within said hose and glued to said first coupling;

a second coupling at said second end for inserting into the fuel tank of said vehicle; and a second barb fitting within said hose and glued to said second coupling.

9. The filler assembly as set forth in claim 8 and further including:

a first clamp encircling said first end for securing said hose to said first barb; and a second clamp encircling said second end for securing said hose to said second barb.

10. The filler assembly as set forth in claim 8 and further including:

an end cap attached to said second coupling for sealing the second end of said filler assembly.

11. The filler assembly as set forth in claim 10 wherein said second coupling is threaded and said end cap is threadable onto said second coupling.

12. The filler assembly as set forth in claim 8 further including a filter captured between the first coupling and the first barb fitting.

* * * * *